US005964162A

United States Patent [19]

Chuan-Jen

[11] Patent Number: 5,964,162

[45] **Date of Patent: *Oct. 12, 1999**

[54] PULP-MOLDED PALLET

[76] Inventor: Hsieh Chuan-Jen, No. 22-46, Lin 1, Sha-Tien Village, Hsin Wu Hsian, Tauyuan Hsien, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 08/948,999

[22] Filed: Oct. 10, 1997

[51] Int. Cl.[6] ..... B65D 19/38

[52] U.S. Cl. ..... 108/57.28; 108/57.29; 108/901

[58] Field of Search ..... 108/51.3, 53.3, 108/57.18, 57.25, 57.28, 901, 902, 57.29

[56] References Cited

U.S. PATENT DOCUMENTS

| | | | |
|---|---|---|---|
| 3,228,358 | 1/1966 | Sepe et al . | |
| 3,433,184 | 3/1969 | Addy | 108/901 X |
| 3,611,952 | 10/1971 | Hoffman | 108/901 X |
| 3,664,271 | 5/1972 | Wolder et al. . | |
| 4,000,704 | 1/1977 | Griffin, Jr. . | |
| 4,408,544 | 10/1983 | Haataja . | |
| 4,674,414 | 6/1987 | Nulle et al. . | |
| 4,960,553 | 10/1990 | DeBruine et al. . | |
| 5,142,994 | 9/1992 | Sandberg et al. | 108/53.3 |
| 5,470,641 | 11/1995 | Shuert | 108/901 X |
| 5,566,624 | 10/1996 | Brown et al. | 108/57.28 |
| 5,669,315 | 9/1997 | Model | 108/51.3 X |

FOREIGN PATENT DOCUMENTS

| | | | |
|---|---|---|---|
| 0272661 | 11/1988 | Japan | 108/57.28 |

*Primary Examiner*—Peter M. Cuomo
*Assistant Examiner*—Hanh V. Tran
*Attorney, Agent, or Firm*—W. Wayne Liauh

[57] ABSTRACT

A pulp-molded pallet includes a panel having a first surface, a second surface and three rows of hollow legs projecting from the panel. Each of said rows of hollow legs includes a plurality of interconnected hollow legs. A plurality of first, second and third recesses are provided to further enhance the overall strength.

2 Claims, 3 Drawing Sheets

PULP-MOLDED PALLET

BACKGROUND OF THE INVENTION

In moving goods in a warehouse, goods are first loaded on a pallet and then the pallet along the loaded goods is lifted by inserting two forks of a forklift into a middle space between a top and a bottom of the pallet. The whole pallet is then transported by the forklift to a desired position. A large number of pallets are usually needed in warehousing to position and load goods. A conventional pallet is made of wooden material and mainly constructed from three thick square battens to which a number of wooden strips are nailed. The wooden strips must be nailed to the batterns by a skilled carpenter to quickly complete the pallet.

Therefore, the manufacture of a conventional pallet is time and labor consuming while high skill and manufacturing cost is required. Moreover, the continuous manufacture of new pallets to replace those old and broken ones necessitates continued felling of trees and accordingly damaging the ecological condition of nature. In the nowaday worldwide appeal for protecting our natural ecological environment, constant felling of trees has become a heinous crime.

SUMMARY OF THE INVENTION

It is therefore tried by the inventor to develop a pallet made of molded recycled pulp to eliminate the drawbacks of high cost and time-consumption as found in the manufacturing of the conventional wooden pallet as well as the dangers of destroying the plant ecological condition. The pallet of the present invention has a compression strength no less than that of the conventional wooden pallet and can be produced on fully atomated production lines to largely reduce the manufacturing cost.

The pulp-molded pallet according to the present invention is mainly formed from two identical units adhered together. The unit each includes a flat bottom having two surfaces. Three rows of equally spaced hollow legs sparately project from a left edge, a central line and a right edge of one surface of the flat bottom. Portions on the flat bottom between two hollow legs of two adjacent rows raise to form corresponding recesses on the other surface of the flat bottom, so as to enhance a bearing strength of the unit. The hollow legs are so shaped and spaced that two units are allowed to fitly adhere and combine together with their hollow legs just fitting into spaces between two adjacent hollow legs in each row on the other unit and thereby form a complete paper-molded pallet.

DETAILED DESCRIPTION OF THE PREFERRED EMBODIMENTS

The present invention relates to a pulp-molded pallet. FIGS. 1 to 4 shows a preferred embodiment of the present invention which each mainly includes two identical units 10 being integrally molded from pulp and adhered together.

Figure 1:
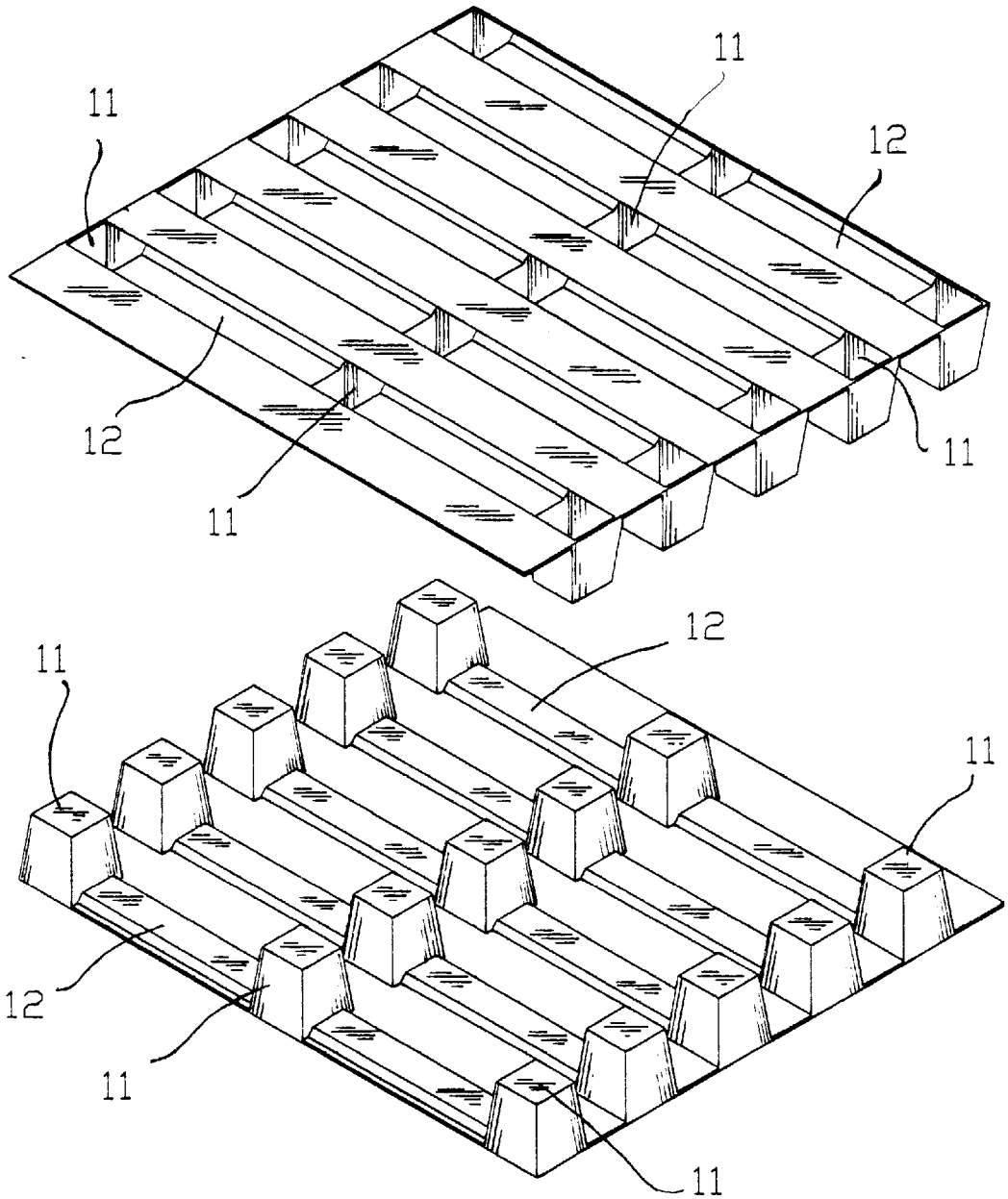
FIG. 1 is an exploded perspective of a pulp-molded pallet according to a preferred embodiment of the present invention.
Figure 2:
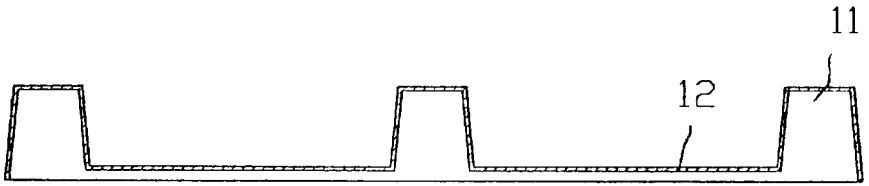
FIG. 2 is a sectional view of one unit forming a part of the pallet of FIG. 1.
Figure 3:
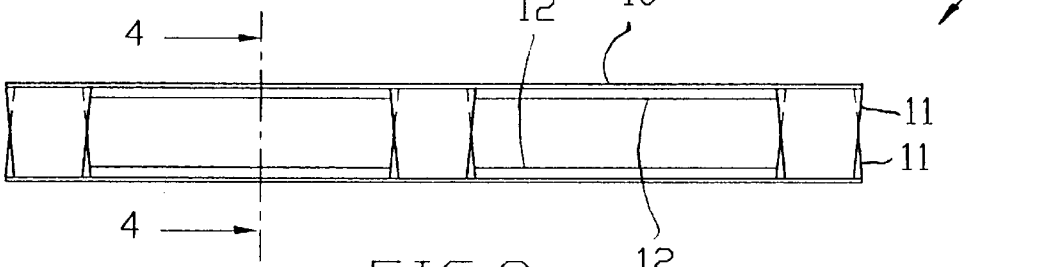
FIG. 3 is a front view of the pallet of FIG. 1 in an assembled state.
Figure 4:
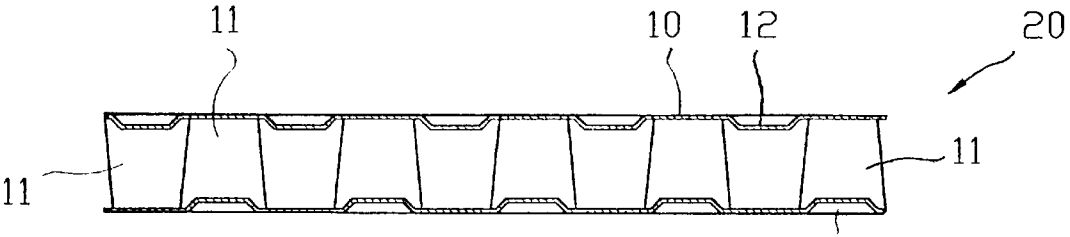
FIG. 4 is a sectional view taken on line 4—4 of FIG. 3.

The unit 10 includes a flat bottom having a first and a second surface. Three rows of hollow legs 11 project from the first surface of the unit 10 to separately locate along a left edge, a central line, and a right edge of the first surface. The legs 11 in each row are equally spaced. Moreover, portions on the flat bottom of the unit 10 between two hollow legs 11 of two adjacent rows are molded to raise from the first surface and therefore form corresponding recesses 12 on the second surface of the bottom. These recesses 12 have the function of reinforcing a supporting strength of the whole unit 10. Two units 10 are adhered together by facing their first surfaces toward each other. The hollow legs 11 are so shaped and spaced that the two units 10 are allowed to fitly combine together with each row of hollow legs 11 on a first unit 10 just fitting into spaces between two adjacent hollow legs 11 in each row on a second unit 10, and thereby forms a complete paper-molded pallet 20 as shown in FIG. 3.

The unit 10 for forming the pallet 20 can be made of recycled paper pulp and be integrally molded on an automatic machine, so that the unit 10 can be produced easily, quickly and economically. To adhere two units 10 together, the units 10 can also be applied with glue on their contacting surfaces and then be pressed against each other to enhance the adhesion between them all on automatic machines. The production of complete pallets 20 can also be achieved in a quick manner.

After two units 10 are adhered together to form a complete pallet 20, their three rows of hollow legs 11 together form three supporting walls extending between two first surfaces of the flat bottoms of the units 10. These three supporting walls provide the pallet 20 with sufficient strength to support loads on any one of the second surfaces of the two units 10 adhered together. The recesses 12 on the second surfaces of the units 10 also enhance the strength of the units 10 to enable the pallet 20 to support more loads.

Figure 5:
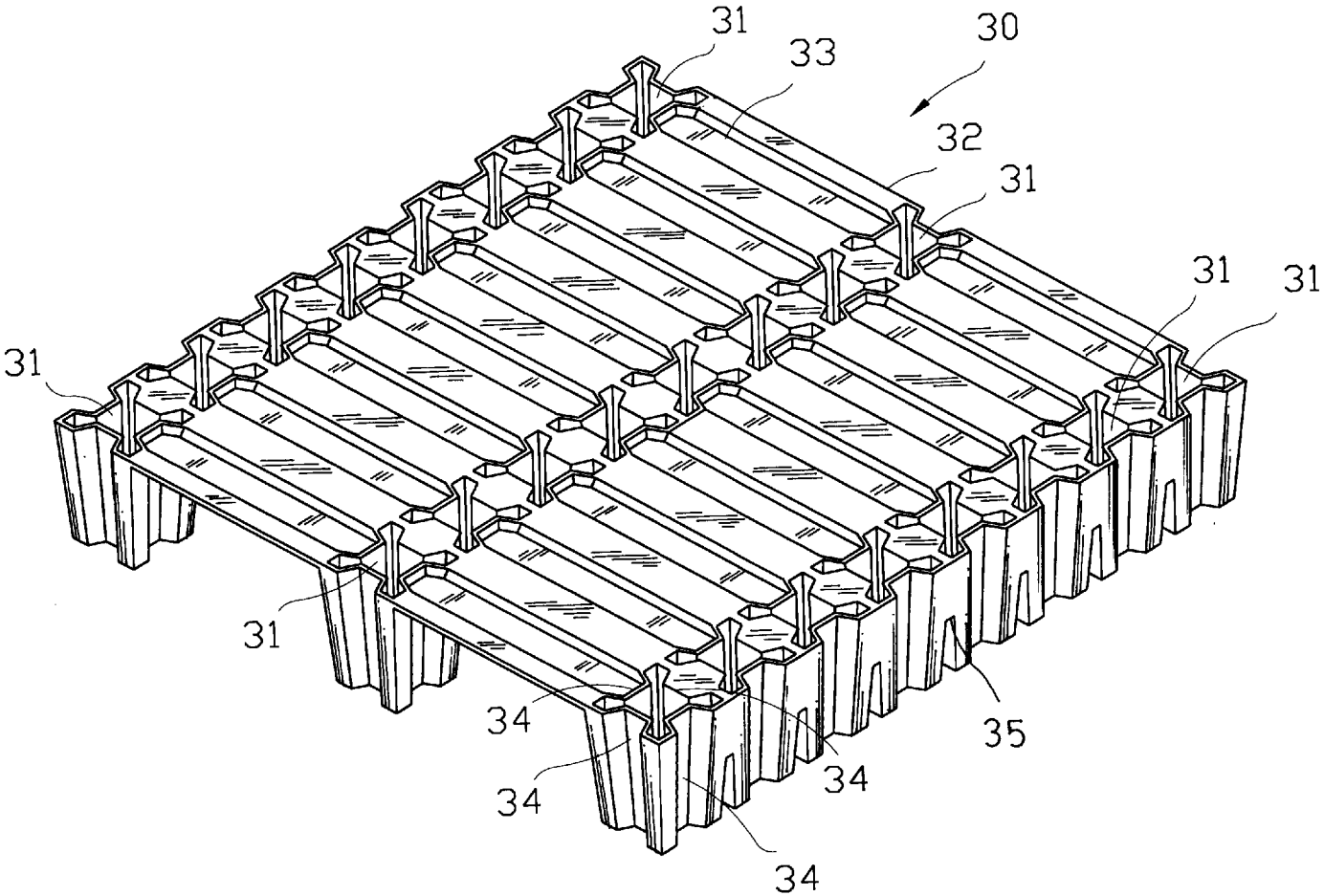
FIG. 5 is a perspective of a pulp-molded pallet according to another embodiment of the present invention.

There are occasions the pallet 20 formed from two adhered units 10 is not suitable for use with a handcart (not shown) which can sometimes be used to lift goods. Therefore, another paper-molded pallet 30 according to a second embodiment of the present invention as shown in FIG. 5 is developed to replace the pallet 20 in such occasions. The pallet 30 itself is a complete unit which includes a flat bottom or panel 32 having a first and a second surface. Three rows of continuous hollow legs 31 project from the first surface of the flat bottom to extend along a left edge, a central line, and a right edge of the surface. Continuous hollow legs 31 may provide the pallet 30 with enhanced supporting strength. Moreover, portions on the first surface of the flat bottom 32 between two legs of two adjacent rows are molded to raise from the first surface and therefore form corresponding recesses 33 on the second surface of the flat bottom 32. These recesses 33 have the function of providing the flat bottom 32 with enhanced supporting strength. A handcart may be easily moved to extend its forks under the pallet 30 and lift the same. To further strengthen the hollow legs 31, each side wall of the hollow legs 31 may be molded to have a recess 34. Further, a plurality of recesses 35 may be molded to extended inwardly from the side walls of two adjacent legs of the hollow legs.

Similarly, recesses may also be formed on side walls of the hollow legs 11 of the units 10 of the pallet 20 to enhance the strength of the legs 11.

A pulp-molded pallet may have compression strength and bearing strength determined by a wall thickness of the pallet and the provision of recesses 12, 33 on the flat bottom of the pallet 20, 30. To meet actual needs, the pallet according to the present invention may be properly modified in its dimensions, thickness, and detailed structural design. Resin may be sprayed over the unit 10 or the pallet 30 so as to form a layer of high-hardness protective coating on the surfaces of the unit 10 or the pallet 30.

In brief, the pulp-molded pallet according to the present invention can be made at low cost and high speed without the need of felling trees, and is therefore an environmental friendly product.

What is claimed is:

1. A pulp-molded pallet formed from one single unit which is integrally molded from pulp, said pallet comprising:

a panel having a first surface, a second surface, and three rows of hollow legs projecting from said panel along a left edge, a central line, and a right edge of said first surface, respectively, each said row of hollow legs being continuously extending over an entire length of said panel;

wherein each said row of hollow legs comprising a plurality of interconnected hollow legs, with each leg having an outer wall extending downwardly from the panel, a plurality of first recesses extending inwardly from the outer walls of said plurality of hollow legs;

a plurality of second recesses extending downwardly from said panel and being provided between each adjacent row of hollow legs to provide enhanced strength; and each of said hollow legs further comprising a plurality of third recesses extending inwardly from the outer walls of two adjacent legs of said plurality of hollow legs.

2. A pulp-molded pallet as claimed in claim 1, wherein said unit has all surfaces thereof sprayed with a layer of resin which sets and forms a high-hardness protective coating of said unit.

* * * * *